United States Patent [19]

Felter

[11] 4,145,102

[45] Mar. 20, 1979

[54] COMBINED CHUCK WRENCH AND ELECTRIC PLUG

[75] Inventor: John V. Felter, Austin, Tex.

[73] Assignee: Midcon Pipeline Equipment Co., Houston, Tex.

[21] Appl. No.: 840,272

[22] Filed: Oct. 7, 1977

[51] Int. Cl.[2] ..... B25B 13/44; H01R 3/00; H01R 13/40

[52] U.S. Cl. ..... 339/14 P; 81/90 A; 279/1 K; 339/147 P; 339/218 R

[58] Field of Search ..... 339/14 P, 58, 147 R, 339/147 P, 147 C, 218 R, 218 M; 81/90 A; 279/1 K; 408/241 R; 7/138

[56] References Cited

U.S. PATENT DOCUMENTS

| | | | |
|---|---|---|---|
| 2,257,559 | 9/1941 | Albertson | 81/90 A |
| 2,941,426 | 6/1960 | Muller et al. | 81/90 A |
| 3,049,946 | 8/1962 | Schelke | 408/241 |
| 3,761,654 | 9/1973 | Davis | 279/1 K |

*Primary Examiner*—Neil Abrams
*Attorney, Agent, or Firm*—Carl B. Fox, Jr.

[57] ABSTRACT

Combined chuck wrench and electric plug, wherein the handle or shaft of a chuck wrench structure is molded into the body of the electric plug, the operating wrench end extending from the electric plug body in a position for use in adjusting, tightening and releasing a chuck. The electric plug must be removed from a socket before the chuck wrench may be used, thereby insuring the user against the possibility of incurring an electric shock and against the possibility of injury from operation of a tool while the chuck is being adjusted.

10 Claims, 6 Drawing Figures

COMBINED CHUCK WRENCH AND ELECTRIC PLUG

BACKGROUND OF THE INVENTION

Users of electric power tools with chucks, such as electric drills, rotary sanders, and the like, are susceptible to being injured if the chuck is manipulated while the cord of the power tool is plugged in. The tool can be inadvertently turned on while a bit or the like is being removed, inserted or tightened, which can result in serious injury. In case the cord of the power tool has been damaged, electric shock can result. Additionally, unless the chuck wrench is properly secured to the cord or secured in some other manner, it can be lost. Chuck wrench holders commonly in use without exception permit freeing of the chuck wrench, so that the chuck wrench can be lost even though such a holder is provided and used. The handles of chuck wrenches are usually either in the form of a bent steel bar or in the form of a longitudinally slidable bar and can be somewhat awkward in use.

This invention overcomes the problems associated with ordinary chuck wrenches and their use, and provides a combined chuck wrench and electric plug which is entirely safe and comfortable in use, and which cannot be inadvertently lost or misplaced.

SUMMARY OF THE INVENTION

The invention provides, in several forms, combined chuck wrenches and electric plugs. The electric plug must be free of or removed from an electric socket from which the power tool will receive electric power when in use before the chuck wrench may be used. The handle of the chuck wrench is molded into the body of the electric plug in a manner whereby the chuck wrench cannot be removed from the electric plug. The wrench end of the chuck wrench may be disposed in either longitudinal direction with respect to the body of the electric plug. In one form, the handle of the chuck wrench serves as the ground for the electric cord system, one end of the chuck wrench handle being plugged into the ground opening of the socket and the other end of the handle being wired to the ground wire of the cord or cable.

A principal object of the invention is to provide an improved form of chuck wrench which cannot be lost and which is safe in use. Another object of the invention is to provide an improved form of chuck wrench which is incorporated into the body of an electric plug. Still another object of the invention is to provide such a chuck wrench wherein the electric plug must be in unplugged condition in order for the chuck wrench to be in a satisfactory position for use. A further object of the invention is to provide a combined electric plug and chuck wrench. Other objects of the invention are to provide such structures which are economical, dependable, and safe in use.

Other objects and advantages of the invention will appear from the following detailed descriptions of preferred embodiments of the apparatus, reference being made to the accompanying drawings.

BRIEF DESCRIPTIONS OF THE DRAWINGS

DESCRIPTIONS OF THE PREFERRED EMBODIMENTS

Figure 1:
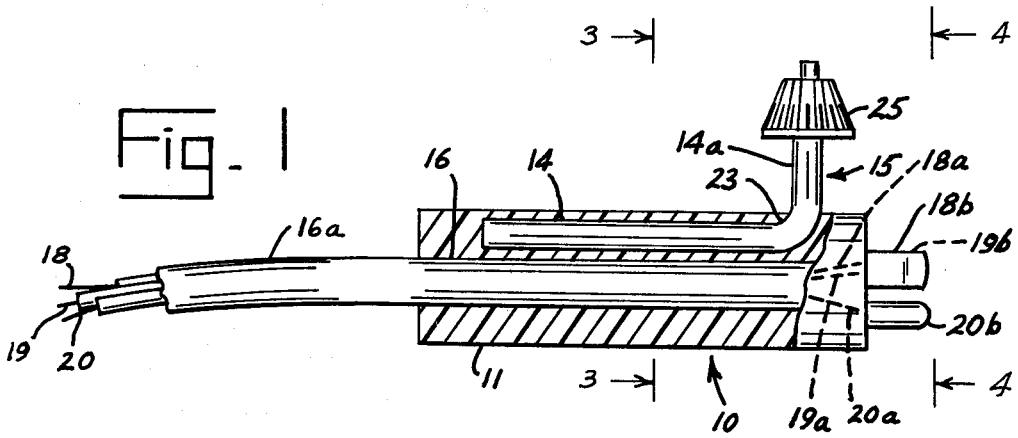
FIG. 1 is an axial cross section of a preferred embodiment of apparatus according to the invention.
Figure 3:
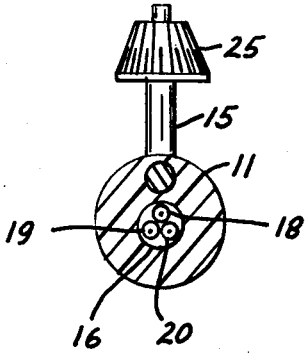
FIG. 3 is a transverse cross section taken at line 3—3 of FIG. 1.
Figure 4:
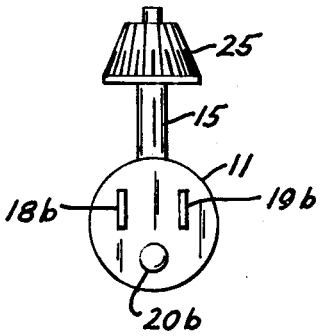
FIG. 4 is an end view taken at line 4—4 of FIG. 1.

Referring now to the drawings in detail, and first to FIGS. 1, 3 and 4, a combined chuck wrench and electric plug 10 of preferred form according to the invention includes a molded body 11 within which is disposed the handle 14 of chuck wrench 15, and the electrical conductor cable or cord 16. Cord 16 extends at **16*a* outside of the end of body 11**.

Cord 16 has therewithin the three separately insulated metallic electrical conductor wires 18, 19 and 20. The wires 18, 19 are shown as uniform wires, but instead may be of twisted wire construction. The wire 20 is a ground wire, and it too may be of single uniform wire construction or of twisted wire construction, usually the former. At **18*a*, 19*a* and 20*a*, these conductors are indicated to be connected to the insertable plug contacts 18*b*, 19*b* and 20*b*, respectively. These electrical connections of the wires to the plug contact elements are made in the customary manner, and imbedded in body 11, as will be further explained in connection with FIGS. 5 and 6** of the drawings.

Body 11 is molded of an insulating material such as soft or hard natural or synthetic rubber, or a suitable plastic or resin. The wrench, cord and conductor elements, and the plug contacts, are held in position during molding, so that each element is properly positioned and so that the electrical conductor wires are separated to be insulated one from the other and from the exterior by the material of which body 11 is formed.

Handle 14 of wrench 15 is bent at 23 so that its portion **14*a* extends transversely. The bend 23 is imbedded in the rubber or plastic, or the like, forming body 11, so that the wrench handle is firmly positioned and cannot be withdrawn from body 11. The toothed wrench portion of the chuck wrench, designated by reference numeral 25, is positioned outside of body 11 in a position for use when the plug contacts are not disposed in an electrical socket. Body 11** serves as a handle for the chuck wrench, being of a smooth cylindrical shape readily grasped by the hand and comfortable to use.

As will be apparent, the metallic handle 14 of the chuck wrench is well insulated from the electrical conductors passing through the body 11, so that there is no danger that the chuck wrench will come into contact with the current carrying wires.

Figure 2:
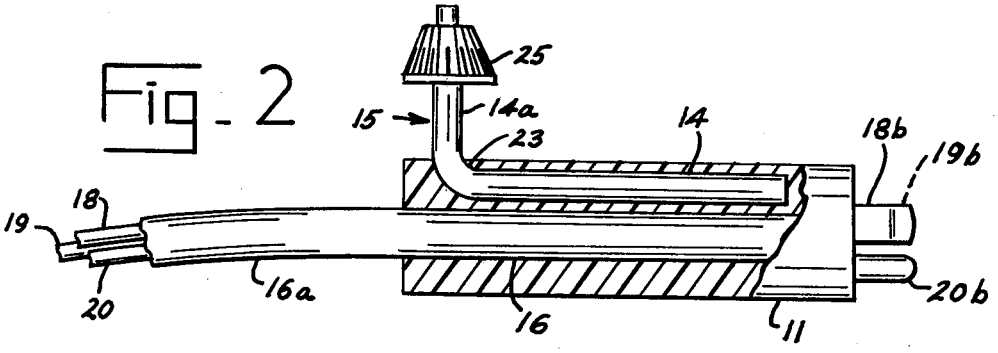
FIG. 2 is an axial cross section of another preferred embodiment of apparatus according to the invention.

Referring now to FIG. 2 of the drawings, the combined chuck wrench and electric plug structure 30 therein shown is identical with structure 10, except that the chuck wrench 15 is disposed in the opposite direction than is the chuck wrench shown in FIG. 1. Again, the electrical conductors are well insulated from the metal chuck wrench, and the components are firmly fixed in position so that the entire structure is integrated together permanently. As before, the plug must be removed from an electrical socket before the chuck wrench can readily be used. The FIG. 1 embodiment is preferred over the FIG. 2 embodiment, because the wrench end 25 will be more effectively blocked by a wall within which the electrical socket is disposed or by the box containing the electrical socket (not shown). In addition, the end disposition of the wrench part 25 makes it more convenient in use.

Figure 5:
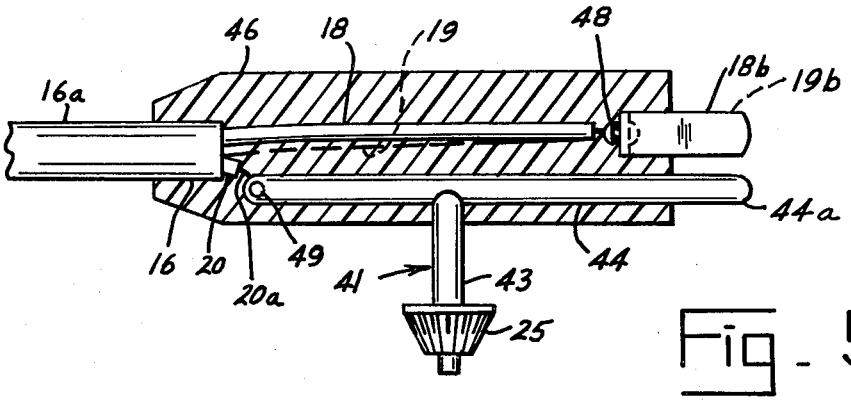
FIG. 5 is an axial cross section of another preferred form of apparatus according to the invention.
Figure 6:
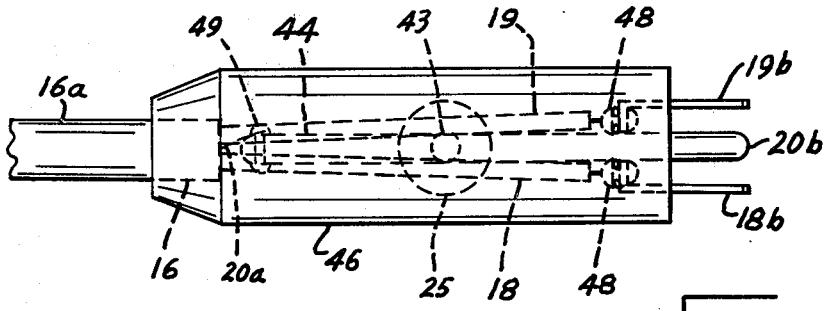
FIG. 6 is a top view of the apparatus shown in FIG. 5.

In FIG. 5 there is shown a combined chuck wrench and electric plug 40 wherein the chuck wrench handle serves as the electrical ground conductor. Wrench 41 has a T-shaped handle 42 including upright bar 43 and integral cross bar 44. Cable or cord 16 has its end portion inbedded in molded body 46, as shown, the remainder 16*a* of the cable extending to a power tool. Insulated conductor wires 18, 19 are imbeddedly extended through body 46, and the conductor wires 18*a*, 19*a* are connected to the lug contacts 18*b*, 19*b* in any suitable manner, as by the connectors 48 shown or by soldering or in any other suitable manner contained in the art. The conductor 20 is cut off shorter than conductors 18, 19 and its conductor wire 20*a* is connected to the end of bar 44 by a connector 49, or by soldering, or in other suitable manner. The bar 44 is of a diameter the same as the diameter of ground contact 20*b*, FIG. 1, and is inserted into the socket to make effective electrical connection in the same manner as ground contact 20*b*. The wrench end 25 is disposed transversely of body 46 to be convenient and comfortable in use when the plug is not disposed in an electrical socket.

In all of its disclosed forms, the combined wrench-plug structures are convenient for use, and the chuck wrench cannot become disassociated from the electric cord of the power tool to be misplaced or lost. In each case, the chuck wrench is not positioned to be conveniently used as a chuck wrench without withdrawal of the apparatus from the electrical socket, so that the power tool will always be disconnected from the socket and deenergized when the chuck wrench portion of the apparatus is used.

While preferred embodiments of the apparatus according to the invention have been described and shown in the drawings, many modifications thereof may be made by a person skilled in the art without departing from the spirit of the invention, and it is intended to protect by Letters Patent all forms of the invention falling within the scope of the following claims.

I claim:

1. Combined chuck wrench and electric plug apparatus, comprising a molded plug body, electric conductor means extending through said body, plug contact means connected to said electric conductor means within said body and extending from said body and being adapted for insertion into an electric socket, and chuck wrench means disposed with its handle portion fixedly molded within said plug body and its wrench portion extending from said plug body, said handle portion having an angular portion molded within said plug body whereby said handle portion is fixed against removal from said plug body and against rotation with respect to said plug body whereby said plug body forms a handle for said wrench portion and whereby said wrench portion is not conveniently assessible for use unless said plug contact means are disconnected from a said electric socket.

2. The combination of claim 1, said electric conductor means comprising a pair of current-carrying electric conductors and a ground conductor, said plug contact means comprising a pair of elongate metal plates each connected to one of said current-carrying conductors, and a cylindrical metal rod connected to said ground conductor.

3. The combination of claim 1, said electric conductor means comprising a cable having three electric conductors disposed longitudinally therethrough and having an end portion thereof moldedly disposed within said molded plug body, the other end of said cable being connected to a power tool having a chuck adapted to be operated by said chuck wrench means.

4. The combination of claim 3, said wrench portion being disposed to face transversely outwardly of a side of said plug body.

5. The combination of claim 4, said handle portion of said chuck wrench means comprising an elongate handle portion imbedded longitudinally within said plug body and being bent within said plug body adjacent said wrench portion to extend transversely outwardly of said plug body.

6. Combined chuck wrench and electric plug apparatus, comprising a molded plug body, electric conductor means extending through said body, plug contact means connected to said electric conductor means within said body and extending from said body and being adapted for insertion into an electric socket, and chuck wrench means disposed with its handle portion fixedly molded within said plug body and its wrench portion extending from said plug body, whereby said plug body forms a handle for said wrench portion and whereby said wrench portion is not conveniently accessible for use unless said plug contact means are disconnected from a said electric socket; said electric conductor means comprising a cable having three electric conductors disposed longitudinally therethrough and having an end portion thereof moldedly disposed within said molded plug body, the other end of said cable being connected to a power tool having a chuck adapted to be operated by said chuck wrench means; said handle portion of said chuck wrench means comprising a first electrically conductive bar portion imbedded longitudinally within said plug body and having an integral second bar portion extending transversely outwardly from said plug body at an intermediate point of said first bar portion and having said wrench portion at its outer end, a ground conductor of said electric conductor means being connected to one end of said first bar portion within said plug body, the other end of said first bar portion extending from said plug body and being adapted to be plugged into the ground receptacle of an electric socket.

7. The combination of claim 6, said electric conductor means including two current carrying conductors connected within said plug body to said two plug contact means having their inner ends imbedded within said plug body and having their outer ends extending from said plug body parallel to said outer end of said first bar portion and being adapted to be plugged into the current carrying receptacles of said electric socket.

8. Electric plug, comprising a molded plug body of dielectric material, electrical contact means mounted within said plug body for mating with the contacts of an electrical socket, and a chuck wrench having its handle portion imbedded within said plug body and having its wrench portion extending from said plug body and accessible for use when said plug is not plugged into said electric socket, said handle portion having at least one angular portion imbedded within said plug body whereby said handle portion may not be removed from said plug body, said plug body serving as a handle for said wrench portion when said wrench portion is used to operate a chuck.

9. The combination of claim 8, said handle portion of said chuck wrench serving as a ground conductor through said plug body.

10. The combination of claim 8, said handle portion being L-shaped and having a portion disposed longitudinally of said plug body and a portion bearing said wrench portion at its outer end extending transversely outward from said plug body.

* * * * *

UNITED STATES PATENT AND TRADEMARK OFFICE

CERTIFICATE OF CORRECTION

PATENT NO. : 4,145,102

DATED : March 20, 1979

INVENTOR(S) : John V. Felter

It is certified that error appears in the above-identified patent and that said Letters Patent are hereby corrected as shown below:

On the title page, delete Item [30].

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*